US007682142B2

(12) United States Patent
Lennemann et al.

(10) Patent No.: US 7,682,142 B2
(45) **Date of Patent: *Mar. 23, 2010**

(54) DEVICE FOR MELT SPINNING, TREATING AND WINDING SYNTHETIC THREADS

(75) Inventors: Friedrich Lennemann, Neumunster (DE); Werner Fruchting, Hohenlockstedt (DE); Claus Matthies, Wasbek (DE)

(73) Assignee: Oerlikon Textile GmbH & Co. KG (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/255,810

(22) Filed: Oct. 22, 2008

(65) Prior Publication Data

US 2009/0041880 A1 Feb. 12, 2009

Related U.S. Application Data

(63) Continuation of application No. PCT/EP2007/003925, filed on May 4, 2007.

(30) Foreign Application Priority Data

May 8, 2006 (DE) ..... 10 2006 021 292
Dec. 22, 2006 (DE) ..... 10 2006 061 332

(51) Int. Cl.
*D01D 13/00* (2006.01)
*D01H 1/16* (2006.01)

(52) U.S. Cl. ..... 425/66; 425/72.2; 425/88; 425/213; 425/377; 425/382.2; 425/404; 425/445; 425/464

(58) Field of Classification Search ..... 425/66, 425/72.2, 88, 213, 377, 382.2, 404, 445, 425/464

See application file for complete search history.

(56) References Cited

U.S. PATENT DOCUMENTS 4,043,718 A * 8/1977 Takenaka et al. ..... 425/72.2
5,251,363 A * 10/1993 Gerhards et al. ..... 28/221

FOREIGN PATENT DOCUMENTS

DE 858005 C 12/1952
DE 3343714 A1 6/1984
DE 195 05 838 * 9/1995

(Continued)

OTHER PUBLICATIONS

Fourne, F., "Synthetische Fasern", Carl Hanser Verlag, Munchen, 1995, pp. 279-285. Ubersicht uber Schmelzspinnanlagen fur Faden.

*Primary Examiner*—Robert B Davis
*Assistant Examiner*—Joseph Leyson
(74) *Attorney, Agent, or Firm*—BainwoodHuang

(57) ABSTRACT

A device for melt spinning, treating and winding synthetic threads includes a spinning unit, a treatment unit and a winding unit. The spinning unit, the treatment unit and the winding unit are arranged in tiers one above the other and form a plurality of single-thread or multi-thread production positions along the longitudinal side of a machine. To permit a rapid, simple operation, in particular at the start of a process and during interruptions of the process, an operator walkway is located at a height between the treatment device and the winding device.

8 Claims, 5 Drawing Sheets

FOREIGN PATENT DOCUMENTS

| | | | |
|---|---|---|---|
| DE | 10009335 | A1 | 9/2000 |
| DE | 10039093 | A1 | 3/2001 |
| DE | 10045473 | A1 | 3/2002 |
| EP | 0350450 | A | 1/1990 |
| EP | 1300496 | A | 4/2003 |
| FR | 2286895 | A1 | 4/1976 |

* cited by examiner 10.1

DEVICE FOR MELT SPINNING, TREATING AND WINDING SYNTHETIC THREADS

CROSS REFERENCE TO RELATED APPLICATIONS

This patent application is a Continuation of International Patent Application No. PCT/EP2007/003925 filed on May 4, 2007, entitled "DEVICE FOR MELT SPINNING, TREATING AND WINDING SYNTHETIC THREADS", the contents and teachings of which are hereby incorporated by reference in their entirety.

FIELD OF THE INVENTION

Embodiments of the invention relate to a device for melt spinning, treating and winding synthetic threads.

BACKGROUND

It is known that with the production of synthetic threads a plurality of filaments is extruded of a polymer melt, which is combined after completing a cycle of a cooling section to the thread. Subsequently, further treatment substantially including stretching, preparation, and swirling occurs in order to then be wound to a spool. The devices of such apparatuses usually extend across multiple levels. Such an apparatus is known, for example, from DE 103 55 294 A1. For this purpose a spinning device for extruding and cooling the threads, a treatment device for the treatment of the threads, and a winding device for winding the threads to spools are arranged on top of each other in a level manner. The devices form a plurality of production positions along a machine longitudinal side for simultaneous winding of multiple threads. In order to obtain an arrangement that is as user friendly as possible, the spinning nozzles are divided into multiple longitudinal modules in the known apparatus. Therefore, the operation of the spinning nozzles can be improved in the spinning directions with the double-sided arrangement.

In practice, however, the operating applications with the production of synthetic threads in the region of the treatment device and the winding device must be carried out more frequently, since each thread breakage requires realigning of the threads. Irrespective of whether the treatment device and the winding device are arranged on top of each other, as is known from DE 103 55 294 A1, or are arranged nested, as is known, for example, from EP 0 718 424 B1, operating heights are the result, particularly in the region of the treatment devices, which may only be overcome by incorporating an additional level, or by means of additional auxiliary means. Furthermore, in the arrangement of the treatment device known from EP 0 718 424 A1 and of the winding device great machine separations also occur, which particularly have the disadvantage in the case of a single thread process guiding that the spinning nozzles required for melt spinning must also be held at larger distances to each other within the heated spinning beam. However, such spinning devices require a large energy demand in order to be able to perform a continuous heating of the melt carrying components across the entire machine length. That is why arrangements of the devices in levels on top of each other are preferred in order to obtain respectively compact spinning devices.

SUMMARY

It is an object of the invention to provide an apparatus for melt spinning, treating and winding synthetic threads of the generic type, wherein particularly the treatment devices and winding devices are embodied in a user friendly manner.

Another goal of the invention is to enable a quick feeding of the threads in the treatment device and the winding device during process interruptions.

This object is solved according to the invention by means of an apparatus for melt spinning, treating and winding synthetic threads, in that an operating platform is arranged at a height between the treatment device and the winding device for the operation of the production positions on the longitudinal side of the machine.

In accordance with certain embodiments, all production positions can be operated from the operating level by one operator. In this manner, the threads spun by the spinning device, for example, can be taken over by the operator directly via a manually guided suction gun, and fed to the following units of the treatment device and the winding device. Therefore, even greater heights can be overcome without any additional auxiliary means by the operator.

In order to obtain a quick feed by the operator despite the separation between the operation of the treatment device and the operation of the winding device, particularly with the process start, or with process interruptions, at least one passage opening is present on the operating platform opposite of the winding device according to an advantageous further embodiment of the invention, through which the thread feed and thread transition may occur. For this purpose the winding device is preferably formed by two spool spindles at a winding position in order to enable the continuous winding of the thread, or of the threads, respectively. One auxiliary device is provided per winding position for the spool exchange such that the winding device winds the spools in an automated manner substantially without any manual intervention.

For the automating of the feed process at the winding position the invention further provides a movable thread guide per winding position, which thread guide can be fed between an operating position adjacent to the passage opening on the operating platform, and through a feed position adjacent to the spool spindle. Therefore, the thread is transferred from the operator to the thread guide in a simple manner, wherein the thread guide guides the thread to the initial feed in a provided feed position.

For this purpose the thread guide can be formed, for example, by an injector device continuously guiding the thread transferred by an operator to a refuse bin. In a particularly inexpensive variation the thread guide is formed by a deflection means that is held on a guide carriage in a height adjustable manner. In this manner the thread can be guided during the feed process in the winding position without transferring the suction gun manually guided by the operator.

The feed process in the winding position can be further improved in that the auxiliary devices of the winding position have at least one pivoting feed arm that can be guided at one guide end in the straight grain formed by the thread guide held in the feed position for deflecting the thread. In this manner the thread can be fed automatically for winding the spool in the winding position without any manual intervention provided by the operator. For this purpose the thread guide may be embodied for guiding one thread, or for guiding multiple threads.

The degree of automation of the device according to the invention can be even further improved by means of the further development of the invention in that a doffing device may be assigned to the winding positions for removal and transport of the spools.

The production positions for melt spinning, treating and winding of one or multiple threads may be utilized in a particularly flexible manner, in that the winding positions of adjacent production positions can be driven and controlled independently of each other according to another preferred further embodiment. Therefore, so-called sympathy thread breakages can be avoided advantageously in a plurality of threads such that the quick and easy operation, in addition to the individual control of the units of the production positions, lead to very little waste.

The treatment units are preferably also driven and controlled independently of each other such that the required operating and maintenance work can be performed quickly and efficiently in the production positions.

In order to obtain an arrangement of the treatment units that is as user friendly as possible, the treatment units are arranged at a frame wall such that a separation results between the thread guiding components and the drives and the electronic components, wherein the drives and controls are preferably embodied on the rear of the frame wall, and the assemblies required for guiding the thread are maintained at a front of the frame wall.

The apparatus according to the invention is particularly suited in order to continuously wind melt spun threads after a one-step or multiple-step treatment onto spools, wherein the user friendly embodiment particularly leads to the avoiding of longer production interruptions, and thus the avoiding of waste during production interruptions. The treatment units of the treatment devices may include godets, swirling devices, preparation devices, suctioning devices, thread monitors, and combinations of such units. In a particularly advantageous manner the apparatus according to the invention may also be utilized for the production of crimped threads. Therefore, additional treatment units are provided per production position, such a texturizing nozzle and cooling drum.

BRIEF DESCRIPTION OF THE DRAWINGS

The apparatus according to the invention is further explained in detail based on a few example embodiments making reference to the attached figures.

DETAILED DESCRIPTION

Figure 1:
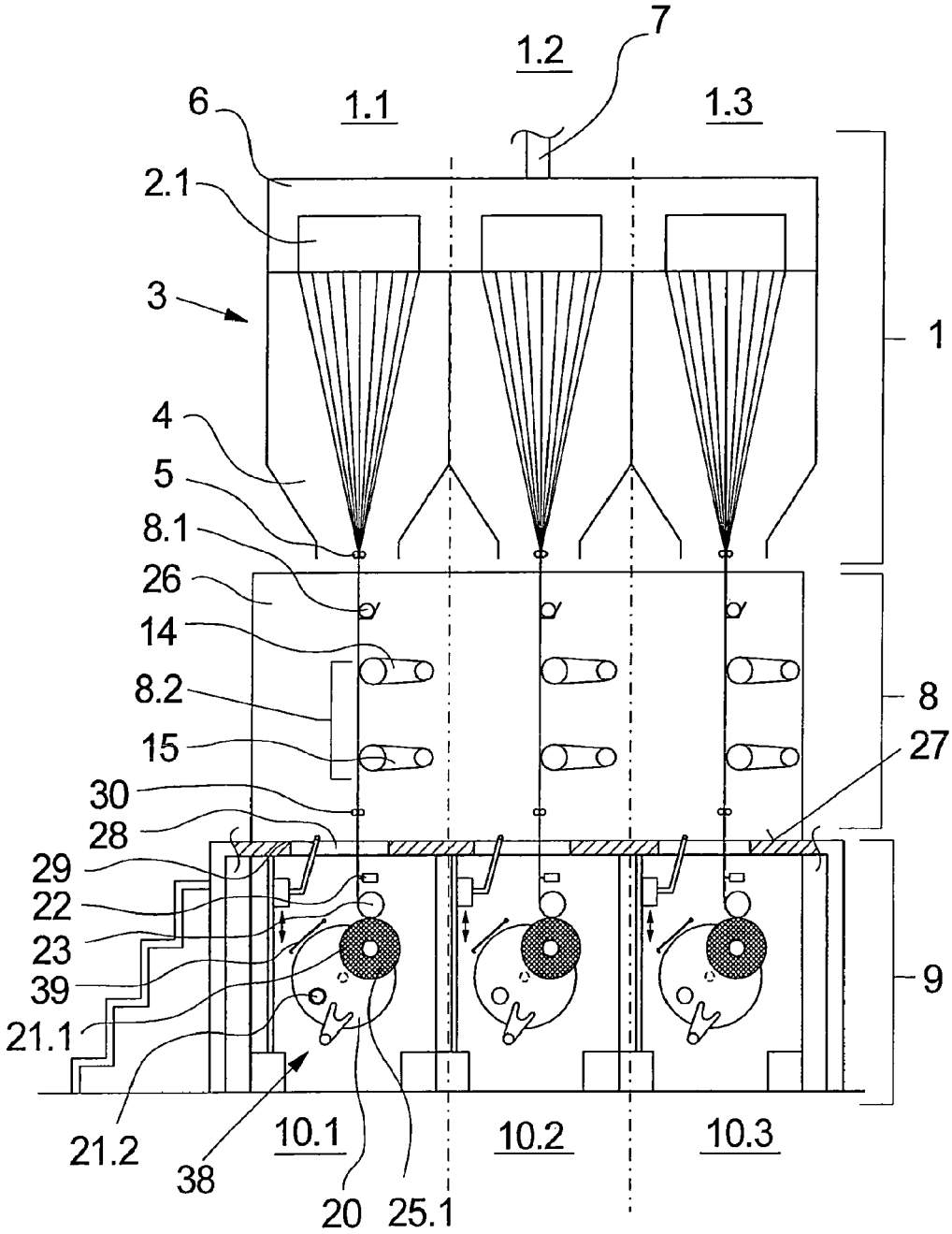
FIG. 1 and FIG. 2 schematically illustrate multiple views of a first example embodiment of the apparatus according to the invention.
Figure 2:
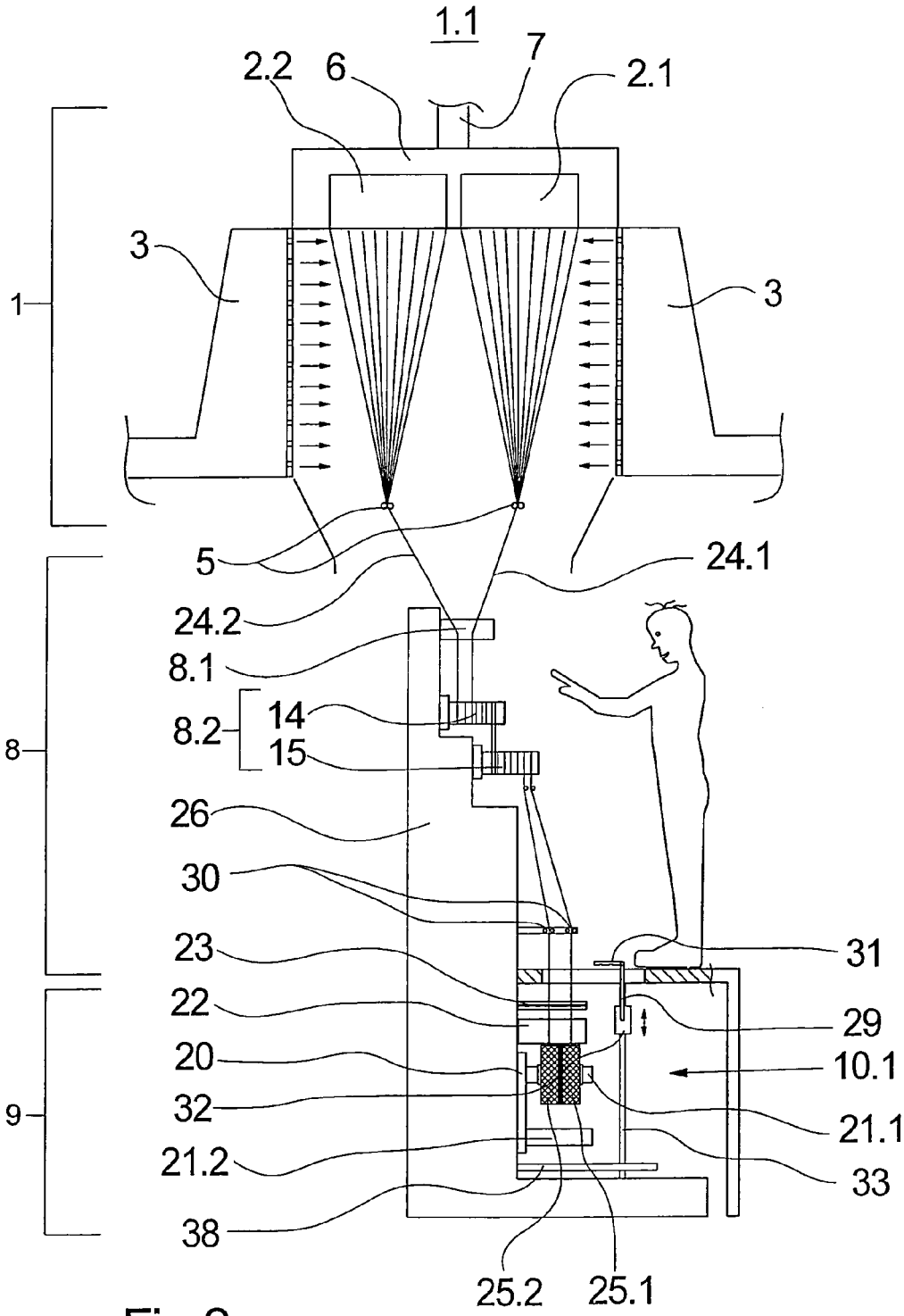

FIG. 1 and FIG. 2 illustrate a first example embodiment of the apparatus according to the invention for melt spinning, treating and winding synthetic threads in multiple views. FIG. 1 schematically illustrates a front view, and FIG. 2 schematically illustrates a side view of the apparatus. In this respect, as no express reference is made to one of the figures, the following description applies to both figures.

The apparatus in this example embodiment is formed by a spinning device 1, a treatment device 8, and a winding device 9, which are arranged on top of each other in stages. The spinning device 1, the treatment device 8, and the winding device 9 overall form three production positions 1.1, 1.2, and 1.3 in order to spin, treat, and wind onto spools multiple threads parallel next to each other. The number of the production position is given as an example. Generally, such apparatuses may have a plurality of production positions in order to simultaneously produce a plurality of threads. A total of two threads 24.1 and 24.2 are simultaneously spun, treated, and wound per production position 1.1, 1.2, and 1.3.

The spinning device 1 has two spinning nozzles 2.1 per production position 1.1, 1.2, and 1.3. The spinning nozzles 2.1 and 2.2 are held at a base of the heated spinning beam. The spinning beam 6 extends across all production positions 1.1, 1.2, and 1.3 such that the spinning nozzles 2.1 and 2.2 are each arranged in two rows of nozzle arrangements. The spinning beam 6 is connected to a melt source (not illustrated) via a melt feed. A polymer melt is distributed onto the individual spinning nozzles 2.1 and 2.2 of the production positions 1.1, 1.2, and 1.3 via the melt feed 7 by means of a distribution system (not illustrated in detail) having associated spinning pumps.

A cooling apparatus 3 is arranged below the spinning beam 6, which interacts with one spinning hopper 4. For this purpose each production position 1.1, 1.2, and 1.3 has a spinning hopper 4 including a conical outlet. The cooling apparatus 3 is embodied as a cross flow blower, wherein a laterally directed cooling air flow is created for cooling the freshly extruded filaments. At this point it should be expressly noted that other cooling principles not illustrated herein may also be utilized for cooling the filaments within the spinning hopper. In this regard, so-called blow candles may also be utilized for cooling, wherein a cooling air flow directed from the interior toward the exterior is created.

The treatment device 8 is arranged below the spinning hoppers 4. The treatment device 8 has one preparation apparatus 8.1 and one stretching apparatus 8.2. per production position 1.1, 1.2, and 1.3. The stretching apparatus 8.2 is connected downstream of the preparation device 8.1, and is formed by a fluke godet duo 14, and a stretching godet duo 15. The fluke godet duo 14 and the stretching godet duo 15 each have at least one driven godet, on the circumference of which the individual threads are guided in multiple enlacements.

The preparation apparatus 8.1, which may be embodied, for example, as a pin preparation, or as a roller preparation as illustrated herein, is associated with the outlet of the spinning hopper 4 directly in the production position 1.1, 1.2, or 1.3, and is combined with a convergence thread guide 5, which combines the filaments extruded through the spinning nozzle 2.1 to one thread 24.1 and 24.2.

The treatment units of the treatment devices 8 are arranged on a frame wall 26. For this purpose the components of the treatment units 8.1 and 8.2 critical for the thread guide protrude from the front of the frame wall 26. The electric drives and the control are arranged on the opposite side on the rear of the frame wall 26. It is generally possible that the treatment device has additional treatment units, such as swirling devices, or alternatively, treatment units, such as individual godets. In this respect the treatment device 8 illustrated in FIG. 1 and FIG. 2 serves as an example.

The winding device 9 is also held on the frame wall 26. For this purpose the frame wall 26 may be embodied as one part, or also in multiple parts. The winding device 9 has a winding position for each production position 1.1, 1.2, and 1.3, which has two driven spool spindles 21.1 and 21.2 for winding the two threads. The spool spindles 21.1 and 21.2 are held on a rotating spindle carrier 20. The spool spindles 21.1 and 21.2 of the winding positions 10.1, 10.2, and 10.3 are alternately guided through the spindle carrier 20 between an operating position and an alternating position. In the operating position the spool spindles 21.1 and 21.2 interact with a pressure roll 23 and a changing device 22 in order to wind the threads 24.1 and 24.2 to one spool 25.1 and 25.2.

Each of the winding positions 10.1, 10.2, and 10.3 has an auxiliary device 38 in order to be able to automatically perform a spool change. The auxiliary device 38, which is formed, for example, by a displacement fork for spools, further has a feed arm 39 that is held laterally next to the spool spindles 21.1 and 21.2, and which supports the initial feed of a thread at a pivoting axis. The function of the feed arm 39 is explained in further detail below.

An operating platform 27 is arranged on the longitudinal side of the machine at the height between the treatment device 8 and the winding device 9 for operating the production positions 1.1, 1.2, and 1.3, particularly when feeding a thread to the treatment device 8 and to the winding device 9. The operating platform 27 extends across the entire length of the longitudinal side of the machine such that an operator can perform all necessary work steps for feeding the thread or for the maintenance of the treatment units 8.1 and 8.2 from the operating platform 27. For example, the threads 24.1 and 24.2 of the production positions 1.1, 1.2, and 1.3 exiting at the spinning hopper 4 during spinning can be transferred by means of a manually guided suction gun, and fed successively to the treatment units 8.1 and 8.2. Due to the raised position of the operating platform 27 on the longitudinal side of the machine, all work operations can be carried out by an operator from one position.

The operating platform 27 has one passage opening 28 each in the region of the winding positions 10.1, 10.2, and 10.3, which enables a thread transfer and a straight grain during a feed process. A movable thread guide 29 is associated with each winding position 10.1, 10.2, and 10.3 for the thread transfer to the winding position that is embodied below the operating platform 27. The movable thread guide 29 can be guided between an operating position and a feed position. FIGS. 1 and 2 show the thread guide 29 in an operating position adjacent to the passage opening 28. In this example embodiment the movable thread guide 29 is formed by a deflection means 31 that is connected to a guide carriage 32 in a projecting manner. The deflection means 31 may be embodied, for example, by a deflection pin, or a deflection roll. The guide carriage 32 is guided in vertical direction on a guide rail 33, and can be therefore displaced between the operating position and a lower feed position. The function of the movable thread guide 29 will be explained in further detail below.

Figure 3:
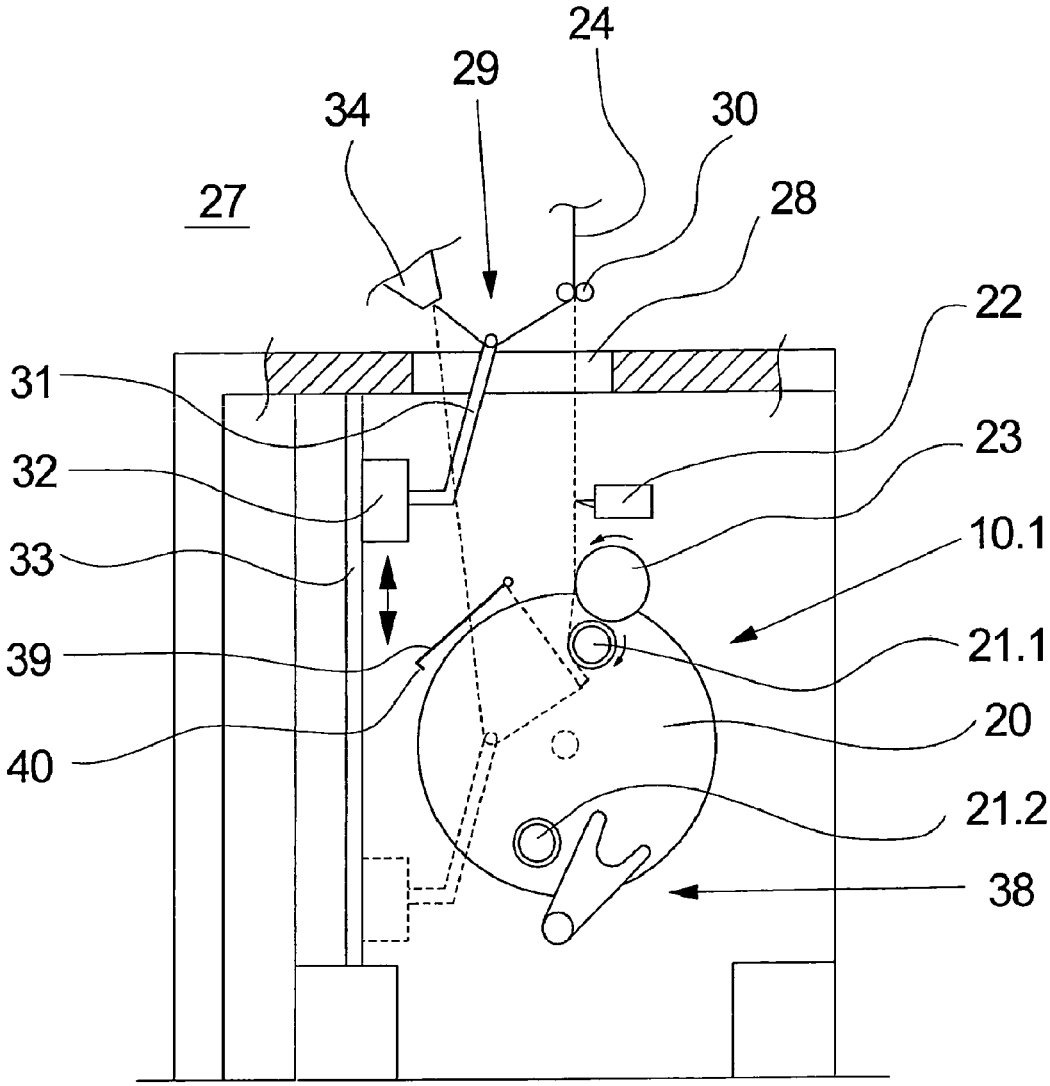
FIG. 3 schematically illustrates a view of a winding device of the example embodiment of FIGS. 1 and 2.

FIG. 3 illustrates an example embodiment of the winding position 10.1 showing the winding device 9 illustrated in FIGS. 1 and 2 in a situation, wherein a thread is fed to a spool spindle for winding a spool at the beginning of the process. For this purpose the situation is illustrated by means of only one at a straight grain.

At the beginning of the feed process the movable thread guide 29 is held adjacent to the passage opening 28 in the operating position thereof. The thread guide 29 has a deflection means 31 for guiding the thread, which is held at the guide carriage 32. The thread 24 is now continuously drawing from a spinning device 1 via a manually guided suction gun 34, and fed to a waste bin. First the thread 24 is inserted into the treatment units 8.1 and 8.2 of the treatment device 8 one after another in order to be threaded into a head thread guide 30 at the end. Then an operator guides the suction gun 34 with the thread around the deflection means 31 into a loop, and keeps the suction gun 34 in a holding position. The thread 24 is threaded into the movable thread guide 29 in this manner. The operator triggers the drive of the guide carriage 32 by means of control elements in the region of the treatment device 8, such that the thread guide 29 moves vertically from the operating position into the feed position toward the bottom. The feed position is indicated in FIG. 3 in the lower region of the guide rail 33 in a dotted line. For this purpose the guide end of the thread guide 29 is held adjacent to the spool spindles 21.1 and 21.2. The straight grain between the head thread guide 30, the deflection pin 31, and the suction gun 34 is also indicated by a dotted line. Now the feed arm 39 of the auxiliary device of the winding position 10.1 is activated during the further course of the feeding process such that a guide end 40 of the feed arm 39 meets the straight grain of the thread 24 guided between the head thread guide 30 and the deflection means 31 at an increasing pivoting angle. The guide end 40 of the feed arm 39 grips the thread and deflects the same in the direction of the spool spindle 21.1. The spool spindle 21.1 holds a spool cartridge including a trapping means such that the thread 24 is gripped and separated. The spool travel of the winding position 10.1 begins. In this manner the winding device 9 may also be advantageously operated from the operating platform 27.

Figure 4:
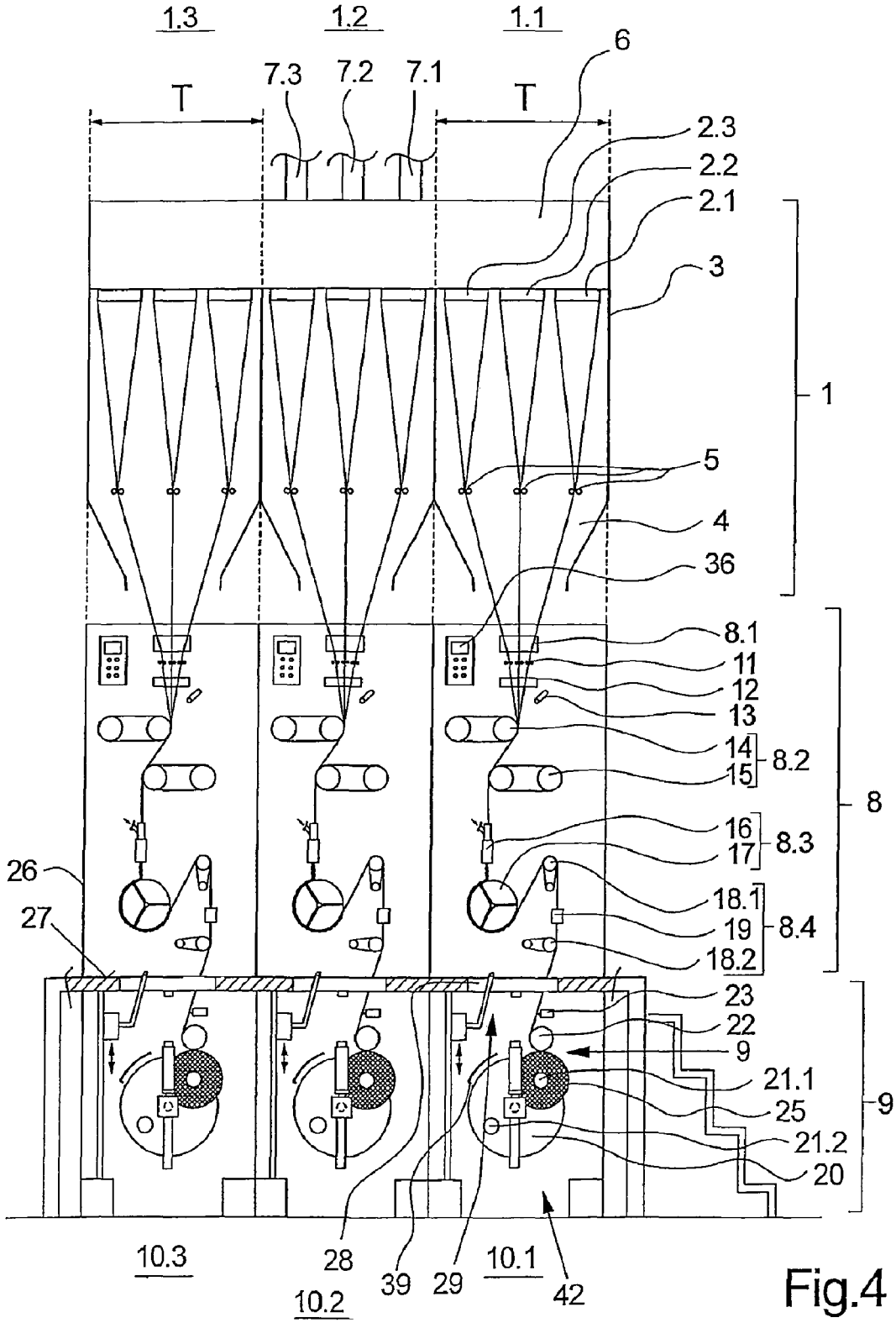
FIG. 4 and FIG. 5 schematically illustrate multiple views of another example embodiment of the apparatus according to the invention.
Figure 5:
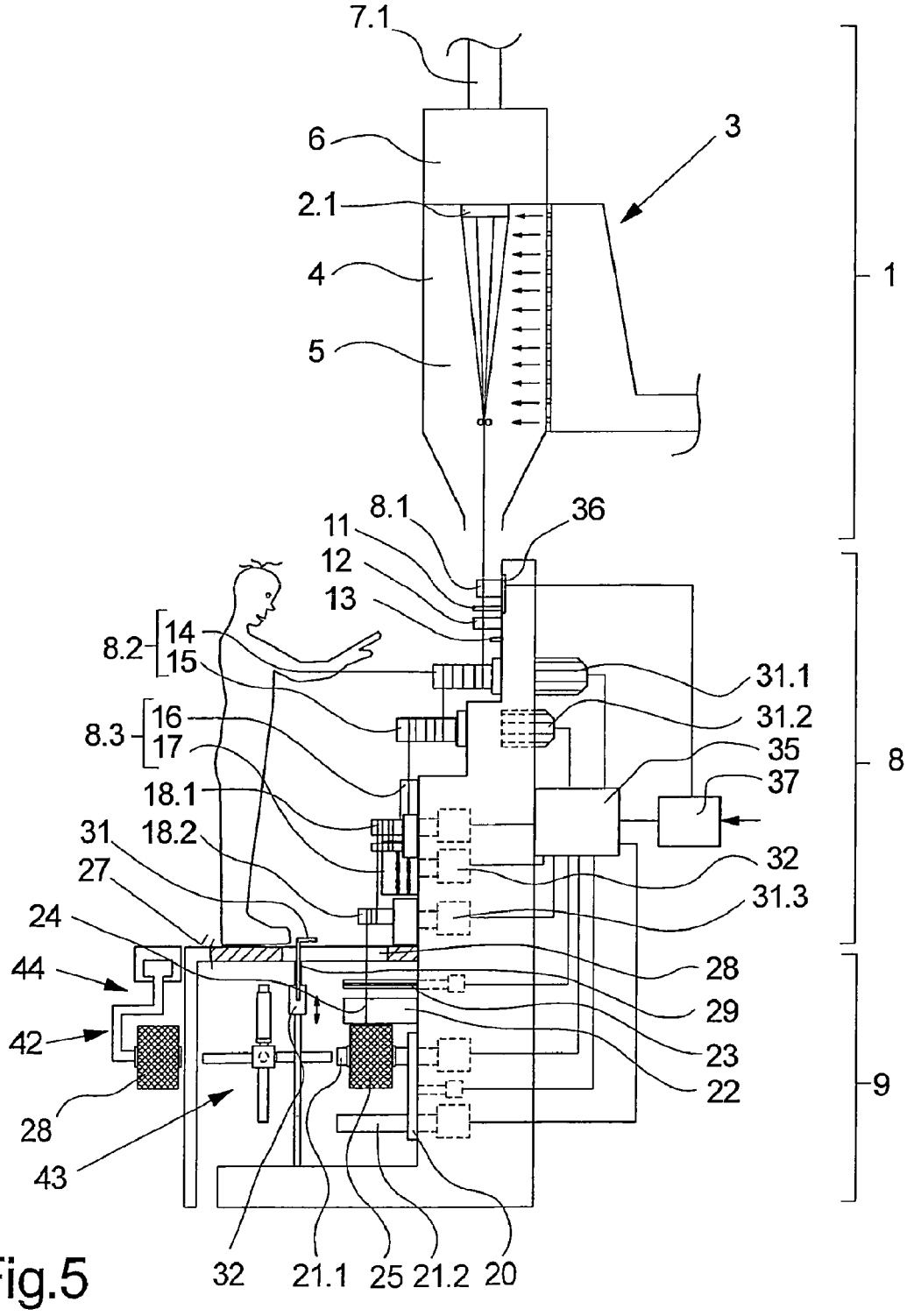

FIGS. 4 and 5 illustrate a further example embodiment of the apparatus according to the invention in several views. FIG. 4 schematically illustrates a front view, and FIG. 5 schematically illustrates a side view of the apparatus. In this respect no express reference is made to one of the figures the following description applies to both figures.

The example embodiment again includes a spinning device 1, a treatment device 8, and a winding device 9. The spinning device 1, the treatment device 8, and the winding device 9 are combined overall to three production positions 1.1, 1.2, and 1.3, having a one-threaded thread guide per production position.

For each production position 1.1 and 1.2 and 1.3 the spinning device 1 contains three spinning nozzles 2.1, 2.2, and 2.3, which are held at a base of a heatable spinning beam 6. For this purpose the spinning 6 beam carries the spinning nozzles 2.1, to 2.3 of the production positions 1.1 to 1.3 in a single row arrangement. The spinning beam 6 is connected to several melt sources (not illustrated) via multiple melt feeds 7.1, 7.2, and 7.3. One polymer melt is supplied through each of the melt sources, which distributes the melt feed 7.1, 7.2, and 7.3 in the distribution system (not illustrated) within the spinning beam 6 with associated spinning pumps on the individual spinning nozzles 2.1, 2.2, and 2.3 of the production positions 1.1, 1.2, and 1.3. In this manner differently dyed polymer melts can be extruded in the spinning nozzles 2.1, 2.2, and 2.3, in order to produce, for example, a so-called tricolor thread per production position 1.1, 1.2, and 1.3, as is usually necessary for the production of carpet. Therefore the filament bundles of the spinning nozzles 2.1, 2.2, and 2.3 in each of the production positions 1.1, 1.2, and 1.3 are combined to one thread.

The cooling apparatus 3 arranged below the spinning beam 6 is identical to the previous example according to FIGS. 1 and 2 such that no further explanations are provided at this point.

The treatment device 8 having treatment units 8.1, 8.2, 8.3, and 8.4 is arranged below the spinning hoppers 4. The treatment device 8 has one preparation device 8.1, one stretching apparatus 8.2, one crimping device 8.3, and one relaxer apparatus 8.4, being held at a frame wall 26 substantially below each other, per production position 1.1, 1.2, and 1.3. For this purpose the components of the treatment units critical for the thread guides protrude from a front of the frame wall 26. The electric drives and controls, however, are held on the opposite side of the frame wall 26.

The stretching apparatus 8.2 is connected downstream of the preparation apparatus 8.1, wherein the stretching apparatus is formed by a fluke godet duo 14, and a stretching godet duo 15. The stretching apparatus 8.2 is followed by the crimping device 8.3, which contains a texturizing nozzle 16 and a cooling drum 17. The individual threads are texturized into a mutual thread within the texturizing nozzle 15, and cooled as a thread stopper at the circumference of the cooling drum 17. After cooling the thread is released from the thread stopper, and fed to the winding device 9 via the relaxer apparatus 8.4. The relaxer apparatus 8.4 contains multiple relaxer godets 18.1 and 18.2, which are each embodied as a driven godet having an associated spillover roller. A swirling device 19 is arranged between the relaxer godets 18.1 and 18.2 in order to compact the thread before winding.

The winding device 9 is embodied substantially identical in its winding positions 10.1, 10.2, and 10.3 to that illustrated in the example embodiment according to FIGS. 1 and 2, wherein only one thread 24 is wound to a spool 25 per winding position 10.1, 10.2, and 10.3. For an explanation as to the construction of the function of the winding positions 10.1, 10.2, and 10.3 reference is made to the previous description of the example embodiment according to FIGS. 1 and 2.

The operating platform 27 having a passage opening 28 opposite of each of the winding positions 10.1, 10.2, and 10.3 extends along the longitudinal side of the machine at the height between the treatment device 8 and the winding device 9. In this respect the thread transfer with the initial feed is carried out via the passage opening 28. A free space is formed below the operating platform 27 for changing the spools at the winding positions 10.1, 10.2, and 10.3. The spool change at the winding positions 10.1 to 10.3 is carried out fully automatically by means of a doffing device 42. For this purpose the doffing device 42 has multiple spool changing apparatuses 43, wherein one of the spool changing apparatuses 43 is associated with the winding position 10.1 to 10.3. The spool changing apparatuses 43 interact with a spool transport device 44. The spools 25 removed at the winding positions 10.1 to 10.3 via the spool transport devices 44. In this example embodiment the spool changing device 44 is embodied as a suspension track. The spool changing apparatus 43 is formed by means of a turnstile arm system, as described in German patent application 10 2006 010855, the teachings of which are incorporated by reference in their entirety.

In order to achieve high flexibility in utilizing the apparatus, the production positions 1.1, 1.2, and 1.3 with their treatment units and winding positions are driven and controlled independently of each other. For this purpose the drive and control electronics of the production positions 1.1 to 1.3 are each separately combined into an electronic assembly unit 35, and are each associated with the production position 1.1 to 1.3. FIG. 5 illustrates the situation for the production position 1.1. For this purpose the electronic assembly unit 35 is held on the rear of the frame wall 26. The godet drives, the roller drive of the cooling drum, the changing drive, the spindle drives of the spool spindles, and the rotational drive of the spindle carrier 20 are connected to the electronic assembly unit 35. Furthermore, additional actuators and sensors may be associated with the treatment units, which are also coupled to the electronic assembly unit 35. A control unit 37 is associated to the electronic assembly unit 35 for the control, which is coupled in an operating panel 36. The operating panel 36 is held at the front of the frame wall 26 so that all process unit functions can be activated by an operator via the operating panel. The operating panel 36 is located in the region of the treatment device 8 above the operating platform 27.

In order to be able to operate the spinning device 1 without interruption in case of a broken thread in one of the production positions 1.1, 1.2, or 1.3, a thread hacker 12 and an intake 13 are associated with each production position 1.1, 1.2, and 1.3 in the feed region of the treatment device 8. The intake 13 that is connected to the waste bin and the thread hacker 12 interact with each other in order to remove the threads from the feed device in case of a process interruption.

The example embodiment according to the invention illustrated in FIGS. 4 and 5 is particularly well suited in order to produce a plurality of composite threads parallel to each other, having a high flexibility from the quick spinning process to the winding. For this purpose the selection of the treatment units held at the production positions serves only as an example. Generally, additional treatment steps, such as a pre-swirling of the thread directly after preparation, or alternative treatment steps, such as a multiple stretching without texturizing, may also be performed. It is also possible to perform treatment steps using a plurality of production position groups of individual production positions in different designs of the process units. In this manner different thread types can be produced using one apparatus.

LIST OF REFERENCE SYMBOLS

1 spinning device
1.1, 1.2, 1.3 production position
2.1, 2.2, 2.3 spinning nozzle
3 cooling apparatus
4 spinning hopper
5 convergence thread guide
6 spinning beam
7 melt feed
8 treatment device
8.1 preparation apparatus
8.2 stretching apparatus
8.3 crimping apparatus
8.4 relaxing apparatus
9 winding device
10.1, 10.2, 10.3 winding position
11 collective thread guide
12 thread hacker
13 intake
14 feed godet duo
15 stretching godet duo
16 texturizing nozzle
17 cooling drum
18.1, 18.2 relaxing godet
19 swirling device
20 spindle carrier
21.1, 21.2 spool spindle
22 changing device
23 pressure roll
24, 24.1, 24.2 thread
25 spool
26 frame wall
27 operating platform
28 passage opening
29 movable thread guide
30 head thread guide
31 deflection means
32 guide carriage
33 guide rail
34 suction gun
35 electronic assembly
36 operating panel
37 control unit
38 auxiliary device
39 feed arm
40 guide end
42 doffing device
43 spool changing apparatus
44 spool transport apparatus

What is claimed is:

1. A device for melt spinning, treating and winding synthetic threads, comprising:

a spinning device, a treatment device, and a winding device arranged on top of each other in stages, and which are arranged at a plurality of single thread or multiple thread production positions along a longitudinal side of the machine, and an operating platform to provide access to the production positions, the operating platform being arranged at the longitudinal side of the machine at a height between the treatment device and the winding device and including one passage opening per production position opposite the winding device, wherein the winding device has, per production position, at least one winding position comprising two spool spindles, which are alternately held in an operating position for winding the spool, and auxiliary devices for spool changing, and wherein a movable thread guide is associated with each winding position, which thread guide is constructed and arranged to be guided back and forth between an operating position adjacent to the passage opening of the operating platform and a feed position adjacent to the spool spindles.

2. The device according to claim 1, wherein the thread guide is formed by a deflection means that is held at a guide carriage in a height adjustable manner.

3. The device according to claim 1, wherein the auxiliary devices of the winding position have a pivoting feed arm constructed and arranged to be guided at a guide end in the straight grain held in the feed position by means of the thread guide for the deflection of the thread.

4. The device according to claim 1, wherein a doffing device is associated with the winding positions for removal and transport of the spools.

5. The device according to claim 1, wherein the winding positions of adjacent production positions are constructed and arranged to be driven and controlled independently of each other.

6. The device according to claim 1, wherein the treatment device has multiple godets per production position for stretching one of the threads, which are constructed and arranged to be driven and controlled independently by the adjacent production position.

7. The device according to claim 6, wherein the godets of the production positions are mutually held at a frame wall, which has a feed device constructed and arranged to support additional treatment units.

8. The device according to claim 7, wherein the additional treatment units per production position are formed by a texturizing nozzle and a cooling drum.

* * * * *